US006210350B1

(12) United States Patent
Finch

(10) Patent No.: US 6,210,350 B1
(45) Date of Patent: Apr. 3, 2001

(54) DEVICE AND METHOD FOR REMOVING IN A SHOWER OR BATH AREA SELECTED SKIN AREAS FROM A BOTTOM FOOT PORTION OF A PERSON

(76) Inventor: Mark K. Finch, 4317 Newhaven Dr., Las Vegas, NV (US) 89117

( * ) Notice: Subject to any disclaimer, the term of this patent is extended or adjusted under 35 U.S.C. 154(b) by 65 days.

(21) Appl. No.: 09/124,372

(22) Filed: Jul. 29, 1998

(51) Int. Cl.[7] ..... A61H 19/00
(52) U.S. Cl. ..... 601/136; 15/112; 15/161
(58) Field of Search ..... 601/136, 127, 601/134; 15/112, 160, 161

(56) References Cited

U.S. PATENT DOCUMENTS

| | | | | |
|---|---|---|---|---|
| D. 336,198 | | 6/1993 | Gibbons . | |
| 4,617,917 | * | 10/1986 | Miller | 601/136 |
| 5,215,348 | | 6/1993 | Wen-Hwang . | |
| 5,293,660 | | 3/1994 | Park . | |
| 5,297,309 | | 3/1994 | Rotili . | |
| 5,322,056 | * | 6/1994 | Menghi et al. | 601/136 |
| 5,575,034 | | 11/1996 | Biernacinski . | |
| 5,729,858 | * | 3/1998 | Riffel | 601/136 X |

FOREIGN PATENT DOCUMENTS 2065460A 7/1980 (GB) .

* cited by examiner

*Primary Examiner*—Michael A. Brown
*Assistant Examiner*—Lalita Hamilton
(74) *Attorney, Agent, or Firm*—Jeffrey Weiss; Jeffrey D. Moy; Weiss & Moy, P. C.

(57) ABSTRACT

A device and method is disclosed for rubbing away by abrasion, selected skin areas of a person's foot or feet in a shower or bath area. An elongated base portion of the device has on a bottom side thereof a plurality of suction cups attached to the bottom side to provide a secure grip to a shower or bath tub floor. The top side of the elongated base portion has an abrasive material attached thereto which functions to permit abrading away of selected skin portions of a person's foot. This abrasive material is also located on two elevated side wall portions that are attached (one to a side) to both sides of the device to permit side portions of a person's foot to receive the abrading operation.

11 Claims, 1 Drawing Sheet

DEVICE AND METHOD FOR REMOVING IN A SHOWER OR BATH AREA SELECTED SKIN AREAS FROM A BOTTOM FOOT PORTION OF A PERSON

RELATED DOCUMENT

This patent application is based upon Disclosure Document No. 430,126, filed Jan. 9, 1998.

BACKGROUND OF THE INVENTION

1. Field of the Invention

This invention generally relates to devices and methods for removing certain skin areas on a person's body and, more particularly, relates to a device and method for removing selected skin areas including callouses from a person's foot in a shower or bath area.

2. Background of the Prior Art

In the past, various devices and methods have been developed and used for removing certain skin areas on a person's body. For example, doctors will often remove warts and other growths from a person's body such as by a surgical type device or by new cryogenic spot freezing techniques. Podiatrists will also remove callouses and/or certain other skin areas such as "corns" from a person's foot by the use of minor surgical cutting techniques using, for example, a scalpel, razor or other type of skin cutting device.

These prior art types of procedures for the removal of certain skin portions on a person's body or feet usually require the assistance of another person such as a doctor like a dermatologist or a podiatrist. However, there are certain types of situations where a person desires to act by themselves in an independent manner in a relatively inexpensive way without the assistance and expense of using another party such as a doctor to remove certain skin areas on their feet.

For example, many people develop certain skin conditions on their feet such as callouses or dead skin portions such as "corns" which often become very uncomfortable and therefore require some form of treatment to ease the pain or discomfort created by these callouses or dead skin portions such as "corns". Simply stated, people don't want to incur the expense and loss in time from a visit to a doctor such as a podiatrist or dermatologist.

Furthermore, for older or other people such as obese people who have difficulty in bending or have arthritis or other ailments or back problems, the removal of selected skin portions from their feet, which includes stains, dead skin, etc., by themselves is very desirable to important foot hygiene.

Accordingly, a need existed for a device and method that could be used to remove dead skin regions on a person's foot or feet without the need of a doctor or a third party and also without the need of a surgical type device. There was also a need for such a device and method that can be used in a shower or bath area where warm water could be used to bathe the person's feet to both clean and soften dead skin portions of the person's feet to facilitate removal thereof by abrasion. Preferably, such a device and method should be used on the floor of the shower or bath in a way that would permit a hands-free dead skin removal operation from the person's feet while maintaining the device in a substantially secure or fixed position on the shower or bath floor. Furthermore, such a device and method would permit either foot to be used to remove skin portions therefrom. Still further, such a device and method would permit side as well as bottom portions of the person's feet to be abraded for the removal of dead skin portions therefrom.

SUMMARY OF THE INVENTION

It is an object of this invention to provide an improved device and method for removing in a shower or bath area selected skin areas from a bottom foot portion of a person.

It is a further object of this invention to provide an improved device and method for removing by abrasion techniques selected skin areas from a bottom foot portion of a person.

It is still further object of this invention to provide an improved device and method for removing by abrasion techniques selected skin areas from bottom and side portions of a person's foot or feet.

It is another object of this invention to provide an improved device and method for removing by abrasion techniques selected skin areas from bottom and side portions of a person's feet or foot in a shower or bath area in a manner where there is use of a secure or substantially fixed device to minimize chances of slipping.

It is still another object of this invention to provide an improved device and method for removing by abrasion techniques selected skin areas from bottom and side portions of a person's feet or foot in a shower or bath area wherein either foot can be used with a single device to achieve abrading away of the selected skin areas.

BRIEF DESCRIPTION OF THE PREFERRED EMBODIMENTS

In accordance with one embodiment of this invention, a device is provided for rubbing a person's bottom foot portion in a shower or bath area to remove select areas of a person's skin such as callouses which comprises, in combination: an elongated base portion; surface gripping means coupled to a bottom surface portion of the elongated base portion for providing a grip to a shower or bath area surface; and abrasive means coupled to a top surface portion of the elongated base portion for removing selected areas of skin including callouses on a person's bottom foot portion.

In accordance with another embodiment of this invention, a method is disclosed for rubbing a person's bottom foot portion in a shower or bath area to remove select areas of a person's skin such as callouses which comprises, in combination; providing an elongated base portion; providing surface gripping means coupled to a bottom surface portion of the elongated base portion for providing a grip to a shower or bath area surface; and providing abrasive means coupled to a top surface portion of the elongated base portion for removing selected areas of skin including callouses on a person's bottom foot portion.

The foregoing and other objects, features and advantages of this invention will be apparent from the following more particular description of the preferred embodiment of the invention as illustrated in the accompanying drawings.

DESCRIPTION OF THE SPECIFICATION

Figure 1:
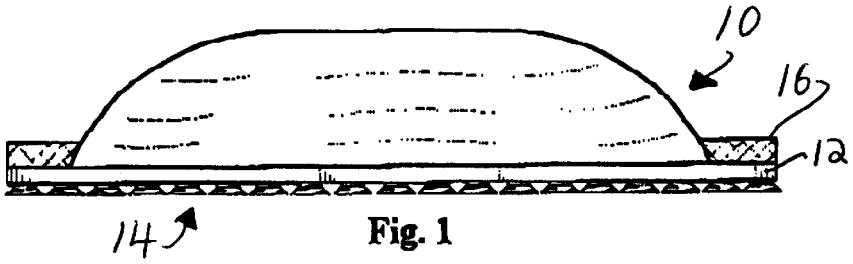
FIG. 1 is a right side elevational view of the foot abrading device of this invention for use in a shower or bath area in abrading selected skin portions of a person's foot.
Figure 4:
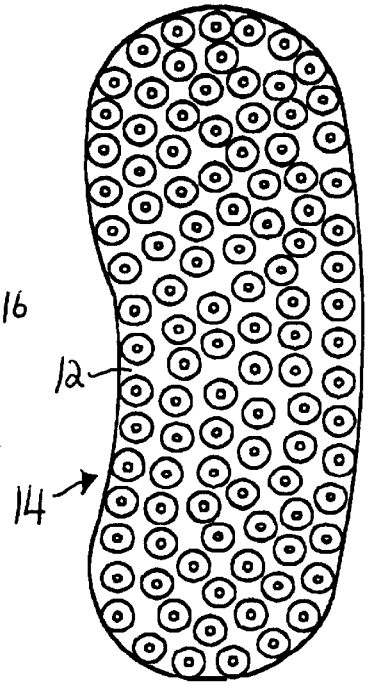
FIG. 4 is a bottom view of the foot abrading device of FIG. 1.

Referring to FIG. 1, a foot abrading device is generally designated by reference numeral 10. The foot abrading device 10 comprises an elongated base portion 12 which is preferably made of a water resistant flexible material such as a rubber or soft plastic type material, however, if desired, a soft fabric type material can also be used. Attached to a bottom surface portion of the elongated base portion 12, by adhesive means or other connection or fastening type means, is a plurality of suction cup members 14 preferably made of rubber or other suitable material (see FIG. 4) that will provide very good gripping to a floor surface area of the shower or bath area. In this manner the foot abrading device 10 will be held securely and firmly in a substantially fixed position on a floor surface area of a shower or bath area.

An abrasive material 16 is attached to a top surface portion of the elongated base portion 12. While various types of abrasive material may be adapted to be used for the abrasive material 16, the abrasive material known by the Trademark SCOTCH BRITE (which is known as a non-woven web material in sheet form for cleaning and finishing all types of surfaces and which is also known as an abrasive scouring sponge or pad) has been found to be particularly good for this foot abrading device 10. This SCOTCH BRITE material is believed to be comprised of a plastic type abrasive material formed in a flexible matted type layer in order to permit a person's foot to be rubbed against this abrasive material 16 to achieve abrading away of selected dead skin portions of a person's foot.

Figure 3:
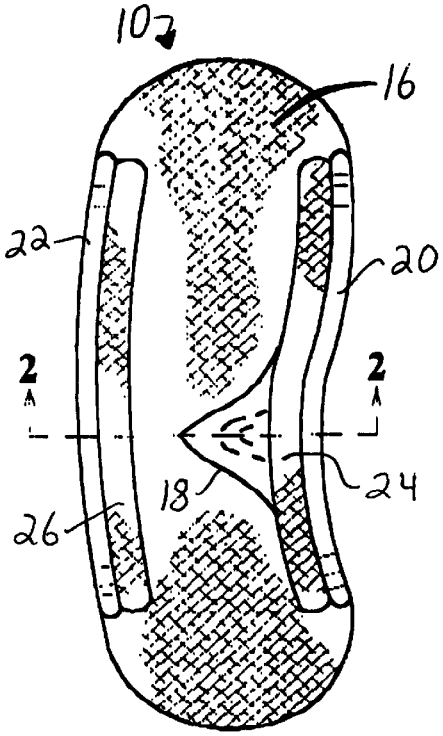
FIG. 3 is a top view of the foot abrading device of this invention.
Figure 2:
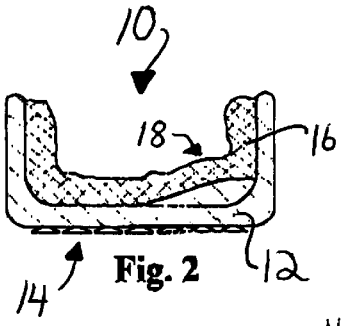
FIG. 2 is a sectional view of the foot abrading device of FIG. 1 taken on the line 2—2 of FIG. 3.

Referring to FIG. 2, this sectional view illustrates how the foot abrading device 10 appears when viewed as a sectional view taken along the line 2—2 of FIG. 3. The view of FIG. 2 also shows a raised arch support region 18 which is shown in FIG. 2 to be on the right side portion of the foot abrading device 10. If desired, the raised arch support region of member 18 can be located on the left side portion of the foot abrading device 10 and the foot abrading device 10 can be curved oppositely to the curvature shown in FIG. 3. The purpose of the raised arch support region or member 18 is to provide better arch support for a person's foot and thereby more comfort in the use of the raised arch support region or member 18 as part of the foot abrading device 10.

The foot abrading device 10 can be used by either foot of a person. For example, for use with a person's left foot, a person would place their left foot on the foot abrading device 10 with the raised arch support 18 being located on the right (or the inside portion of the left foot of the person). For use with a person's right foot, the person would turn around and place their right foot on the foot abrading device 10 with the raised arch support portion or member 18 being located on the right (or the inside portion of the right foot of the person.

Figure 5:
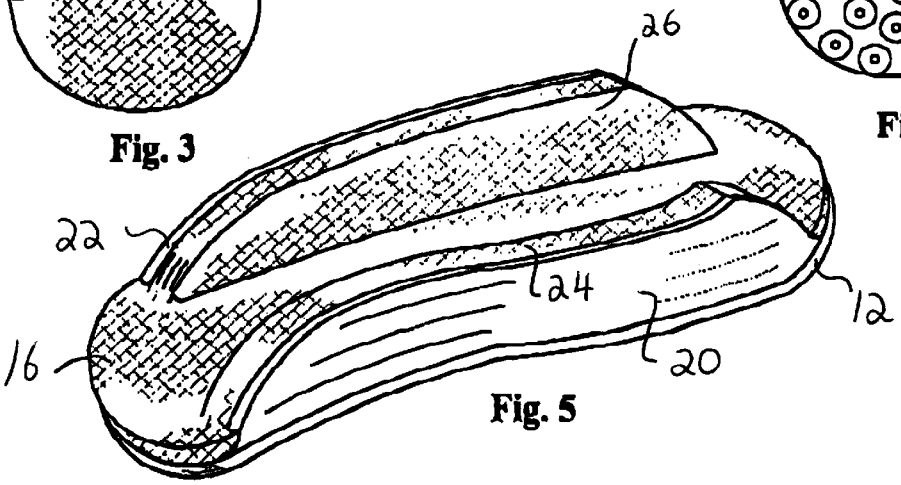
FIG. 5 is a perspective view of the foot abrading device of this invention.

As can be seen with reference to FIGS. 3 and 5, a first flexible side wall portion 20 is shown in FIGS. 3 and 5 as being on the right side portion of the foot abrading device 10. A second flexible side wall portion 22 is shown in FIGS. 3 and 5 as being on the left side portion of the foot abrading device 10. Correspondingly, a first layer of abrasive material 24 is located on the interior portion of the first flexible side wall portion 20 and a second layer of abrasive material 26 is located on the interior portion of the second flexible side wall portion 22.

The first flexible side wall portion 20 is like the second flexible side wall portion 22 and are preferably made of a soft rubber or plastic material to prevent injury to a person's foot using the foot abrading device 10. The first 24 and second 26 layers of abrasive material which are respectively connected to the first 20 and second 22 flexible side wall portions are also flexible to prevent injury to a person's foot using the foot abrading device 10. Furthermore, the configuration provided by the first and second flexible side wall portions 20 and 22 together with their interior first and second layers of abrasive material 24 and 26 define a cavity for a person's foot which provides added stability to the person's foot and also a sandal like configuration and function for the foot abrading device 10.

While the invention has been particularly shown and described with reference to the preferred embodiments thereof, it will be understood by those skilled in the art that the foregoing and other changes in form and details may be made therein without departing from the spirit and scope of the invention.

For example, the elongated base portion 12 can have a thickness of about one-quarter to about one-half of an inch, a length, as desired, such as a length of the person's foot i.e. six to fourteen inches long and a width, as desired, such as a width of the person's foot. The height of the first and second side wall portions 20 and 22 can be varied as desired with a preferred height of at least one and a half inches. If desired, three sizes of the foot abrading device 10 can be utilized, small, medium and large and the use of a soft material such as a soft plastic or rubber type material for the elongated base portion 12 serves to prevent injury to a person's foot if the person accidentally kicked the foot abrading device 10 or incorrectly stepped on it.

I claim:

1. A device for rubbing a person's bottom foot portion in a shower or bath area to remove select areas of a person's skin such as callouses comprising, in combination;

an elongated base portion;

surface gripping means coupled to a bottom surface portion of said elongated base portion for providing a grip to a shower or bath area surface;

abrasive means coupled to a top surface portion of said elongated base portion for removing selected areas of skin including callouses on a person's bottom foot portion, said abrasive material having a rough surface portion and is made out of abrasive scouring pad, and including a substantially arcuately shaped arch support portion having said abrasive scouring pad abrasive material on a surface of said raised arch support portion located along a side portion of the top surface portion of said elongated base portion; and a first flexible side wall portion connected to one side portion of said elongated base portion, said substantially arcuately shaped arch support portion in contact with said first flexible side wall portion, said abrasive scouring pad abrasive material also in contact with said first flexible side wall portion.

2. The device of claim 1 wherein said surface gripping means comprises a plurality of suction cup members connected to the bottom surface portion of said elongated base portion.

3. The method of claim 2 wherein said abrasive means is an abrasive material having a rough surface portion.

4. The device of claim 1 wherein the an abrasive scouring pad material is attached to said top surface portion of said elongated base portion.

5. The device of claim 1 wherein said top surface portion of said elongated base portion is substantially flat and long enough to accommodate the length of the person's foot and wide enough to accommodate the width of the person's foot.

6. The device of claim 1 wherein said surface gripping means comprises a plurality of suction cup members connected to the bottom surface portion of said elongated base portion, said top surface portion of said elongated base portion is substantially flat and long enough to accommodate the width of the person's foot and wide enough to accommodate the width of the person's foot, a substantially arcuately shaped arch support portion for the person's foot located along a portion of the top surface portion of said elongated base portion, said first flexible side wall portion connected to one side portion of said elongated base portion, a second flexible side wall portion connected to the other side portion of said elongated base portion, said abrasive material of said abrasive means also located on interior portions of said first side wall portion and said wall portion and said second flexible side wall portion.

7. A method of rubbing a person's bottom foot portion in a shower or bath area to remove select areas of a person's skin such as callouses comprising, in combination:

providing an elongated base portion;

providing surface gripping means coupled to a bottom surface portion of said elongated base portion for providing a grip to a shower or bath area surface;

providing abrasive means coupled to a top surface portion of said elongated base portion for removing selected areas of skin including callouses on a person's bottom foot portion, said abrasive material having a rough surface portion and is made out of an abrasive scouring pad, and including a substantially arcuately shaped arch support portion having said an abrasive scouring pad abrasive material on a surface of said raised arch support portion located along a side portion of the top surface portion of said elongated base portion; and providing a first flexible side wall portion connected to one side portion of said elongated base portion, said substantially arcuately shaped arch support portion in contact with said first flexible side wall portion, said an abrasive scouring pad abrasive material also in contact with said first flexible side wall portion.

8. The method of claim 7 wherein said surface gripping means comprises a plurality of suction cup members connected to the bottom surface portion of said elongated base portion.

9. The method of claim 7 wherein the SCOTCH BRITE material is attached to said top surface portion of said elongated base portion.

10. The method of claim 7 wherein said top surface portion of said elongated base portion is substantially flat and long enough to accommodate the length of the person's foot and wide enough to accommodate the width of the person's foot.

11. The method of claim 7 wherein said surface gripping means comprises a plurality of suction cup members connected to the bottom surface portion of said elongated base portion, said top surface portion of said elongated base portion is substantially flat and long enough to accommodate the length of the person's foot and wide enough to accommodate the width of the person's foot.

* * * * *